US010676252B2

(12) United States Patent
Pentelovitch et al.

(10) Patent No.: US 10,676,252 B2
(45) Date of Patent: Jun. 9, 2020

(54) CONTAINER WITH SEALABLE LID

(71) Applicant: Helen of Troy Limited, Belleville, St. Michael (BB)

(72) Inventors: Noah Ziman Pentelovitch, New York, NY (US); Conor Patrick McNamara, Montclair, NJ (US); Makiko Kida, Chiba (JP); Tamotsu Matsumoto, Chiba (JP); Nobuyuki Ogasawara, Chiba (JP); Yoshinori Nagata, Chiba (JP)

(73) Assignee: Helen of Troy Limited, St. Michael (BB)

( * ) Notice: Subject to any disclaimer, the term of this patent is extended or adjusted under 35 U.S.C. 154(b) by 96 days.

(21) Appl. No.: 15/850,305

(22) Filed: Dec. 21, 2017

(65) Prior Publication Data

US 2019/0193901 A1 Jun. 27, 2019

(51) Int. Cl.
*B65D 45/32* (2006.01)

(52) U.S. Cl.
CPC ..... *B65D 45/327* (2013.01)

(58) Field of Classification Search
CPC ..... B65D 45/327; B65D 2543/00009; B65D 2543/00027; B65D 2543/00037; B65D 2555/02; B65D 39/12
See application file for complete search history.

(56) References Cited

U.S. PATENT DOCUMENTS

| | | | |
|---|---|---|---|
| 3,430,777 | A | 3/1969 | Esposito, Jr. |
| 3,606,070 | A | 9/1971 | Sheperd |
| 4,303,171 | A | 12/1981 | Schremmer |
| 4,765,498 | A | 8/1988 | Rafferty |
| 5,437,385 | A | 8/1995 | Fillon |
| 6,536,618 | B1 | 3/2003 | Hwang et al. |
| 7,204,383 | B2 | 4/2007 | Hsu |
| 8,479,941 | B2 | 7/2013 | Matsumoto et al. |

(Continued)

FOREIGN PATENT DOCUMENTS

| | | |
|---|---|---|
| CN | 102582944 | 7/2012 |
| CN | 202518588 | 11/2012 |
| KR | 100790549 | 1/2008 |

OTHER PUBLICATIONS

International Search Report filed in PCT/US2016/020626 dated May 11, 2016.

(Continued)

*Primary Examiner* — Kareen K Thomas
(74) *Attorney, Agent, or Firm* — Rankin, Hill & Clark LLP

(57) ABSTRACT

A storage container assembly includes a container having an opening and a lid for covering the opening. The lid includes a top lid, a button, a cam, a base, a lower plate and a gasket. The button is moveable in a first axial direction with respect to the top lid between a projected position and a depressed position. The cam is configured to cooperate with the button such that the button maintains the depressed position when moved from the projected position to the depressed position, and the button remains in the depressed position until pressed again while in the depressed position. The lower plate is connected with the top lid. The gasket is moveable between a contracted state and an expanded state in response to alternate actuations of the button, and the gasket is interposed between the lower plate and the top lid.

20 Claims, 5 Drawing Sheets

(56) References Cited

U.S. PATENT DOCUMENTS

| | | | | |
|---|---|---|---|---|
| 8,807,370 | B2 | 8/2014 | Lee | |
| 9,096,365 | B2 * | 8/2015 | Kim | B65D 81/2038 |
| 9,731,874 | B2 * | 8/2017 | Luo | A47J 47/02 |
| 2007/0241107 | A1 | 10/2007 | Matsumoto | |
| 2011/0011862 | A1 | 1/2011 | Matsumoto | |
| 2012/0199588 | A1 | 8/2012 | Wheeler | |
| 2012/0285958 | A1 | 11/2012 | Lee | |
| 2013/0240532 | A1 | 9/2013 | Lu | |
| 2013/0292291 | A1 | 11/2013 | Lui | |
| 2014/0284333 | A1 | 9/2014 | Poon | |
| 2016/0107805 | A1 | 4/2016 | Luo | |
| 2016/0257458 | A1 * | 9/2016 | Pentelovitch | B65D 45/32 |
| 2016/0368671 | A1 * | 12/2016 | Pentelovitch | B65D 45/327 |
| 2017/0050775 | A1 | 2/2017 | Sanbar | |

OTHER PUBLICATIONS

International Search Report filed in PCT/US2018/054573 dated Jan. 2, 2019.

* cited by examiner

CONTAINER WITH SEALABLE LID

BACKGROUND

This disclosure is related to a storage container having a lid that is able to seal with the container. U.S. Pat. No. 7,815,067 discloses a similar type of container.

SUMMARY

A storage container assembly includes a container having an opening and a lid for covering the opening. The lid includes a top lid, a button, a cam, a base, a lower plate and a gasket. The top lid defines an upper surface of the lid. The button is moveable in a first axial direction with respect to the top lid between a projected position in which a top surface of the button is offset from the upper surface of the lid and a depressed position in which the top surface of the button is nearer to the upper surface of the lid as compared to the projected position. The cam is configured to cooperate with the button such that the button maintains the depressed position when moved from the projected position to the depressed position, and the button remains in the depressed position until pressed again while in the depressed position. The base is connected with the top lid. The cam is positioned between the button and the base. The lower plate is connected with the top lid. The gasket is moveable between a contracted state and an expanded state in response to alternate actuations of the button, and the gasket is interposed between the lower plate and the top lid.

A method for assembling a lid includes placing a cam on a base and placing a web on the base. The web includes a hub, a plurality of arms, a plurality of gasket pushers and a plurality of tensile connector elements. Each arm is connected with the hub and associated with a respective gasket pusher. Each tensile connector element interconnects adjacent gasket pushers. The method further includes connecting a button with the cam, placing a top lid on the base and connecting the base with the top lid. The top lid includes a button opening receiving the button. The method also includes attaching a gasket to the base and attaching a lower plate to at least one of the base and the gasket.

DETAILED DESCRIPTION

Figure 1:
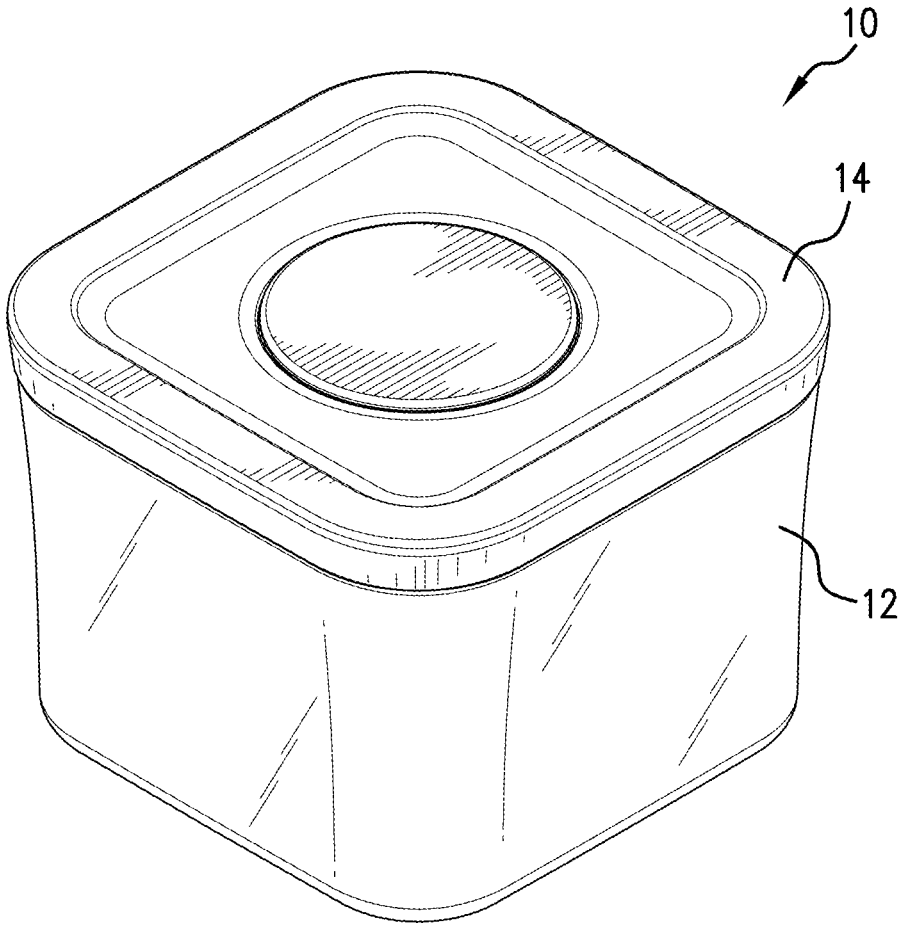
FIG. 1 is a perspective view of a container assembly including a container and a lid that is able to seal with the container.
Figure 2:
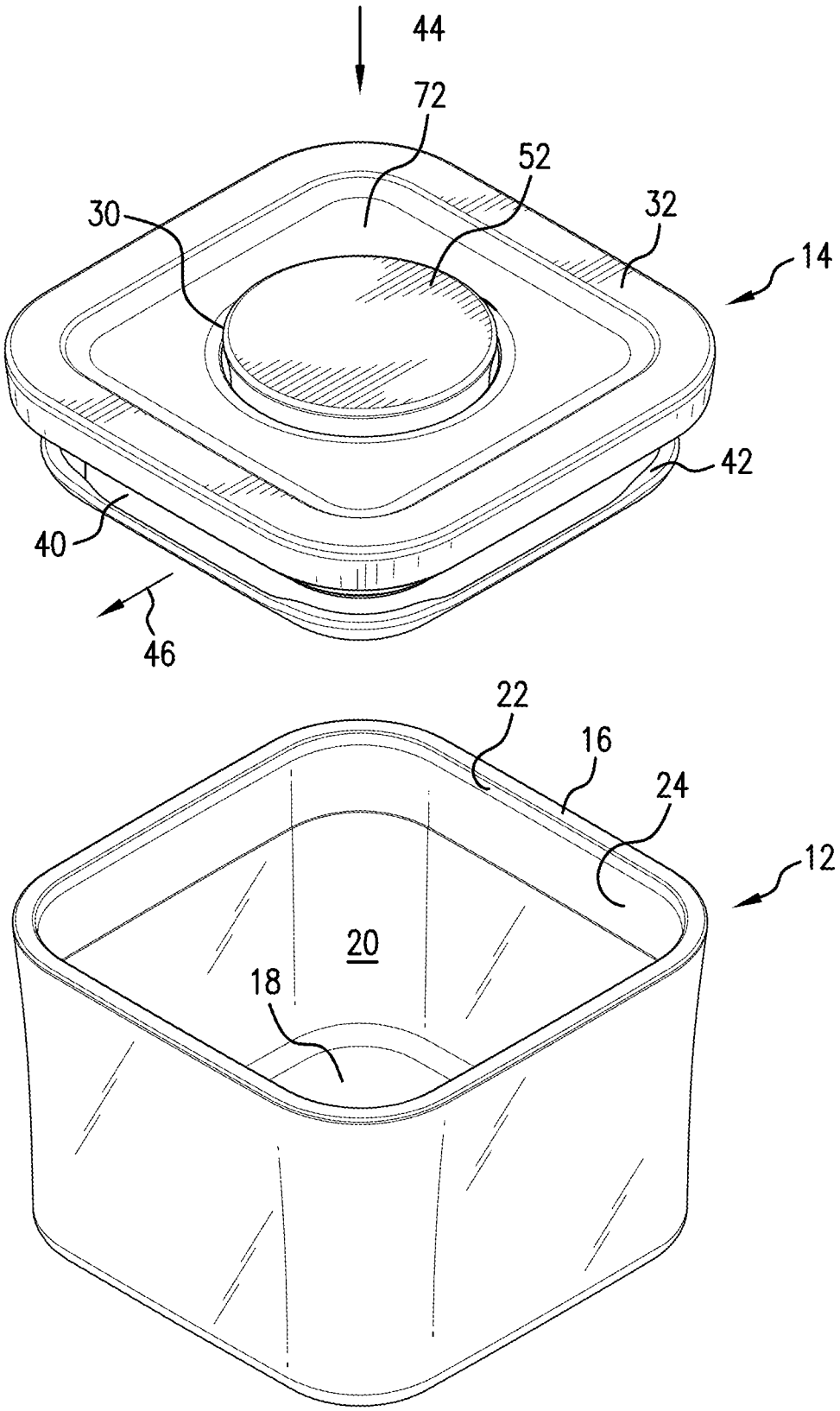
FIG. 2 is another perspective view of the container assembly with the lid removed from the container.

FIG. 1 depicts a storage container assembly 10 including a container 12 and a lid 14. FIG. 2 depicts the lid 14 removed from the container 12. The container 12 includes a side wall 16, which is generally rectangular (square) in configuration (plan view), and a base wall 18. The side wall 16 extends upwardly from a perimeter of the base wall 18 and defines an inner volume 20 in which items can be placed. The side wall defines an upper opening 22 and the lid 14 covers this opening. The side wall 16 also defines an inner surface 24 for the container 12, and the lid 14 can seal against the inner surface 24.

Figure 3:
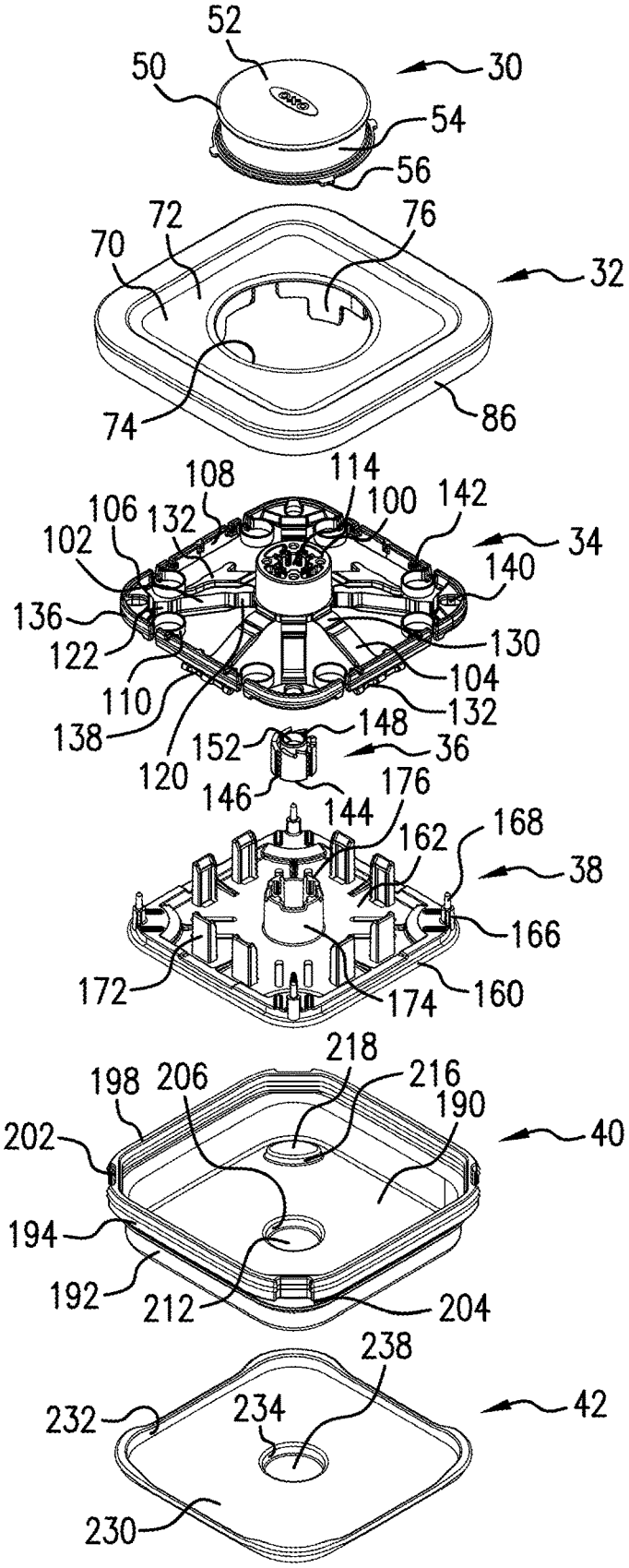
FIG. 3 is an exploded view of the lid for the container assembly depicted in FIGS. 1 and 2.

FIG. 3 depicts an exploded view of the lid 14 shown in FIGS. 1 and 2. The lid 14 includes a button 30, a top lid 32, a web 34, a cam 36, a base 38, a gasket 40, and a lower plate 42. Movement of the button 30 results in movement of the gasket 40. With reference to FIG. 2, movement of the button 30 in a first axial direction, e.g. parallel with arrow 44, results in movement of the gasket 40 in a second axial direction, e.g. parallel with arrow 46, which is perpendicular to the first axial direction. Actuation of the button 30 moves the gasket 40 from a contracted state toward an expanded state in which the gasket 40 would contact the inner surface 24 of the container 12.

Figure 4:
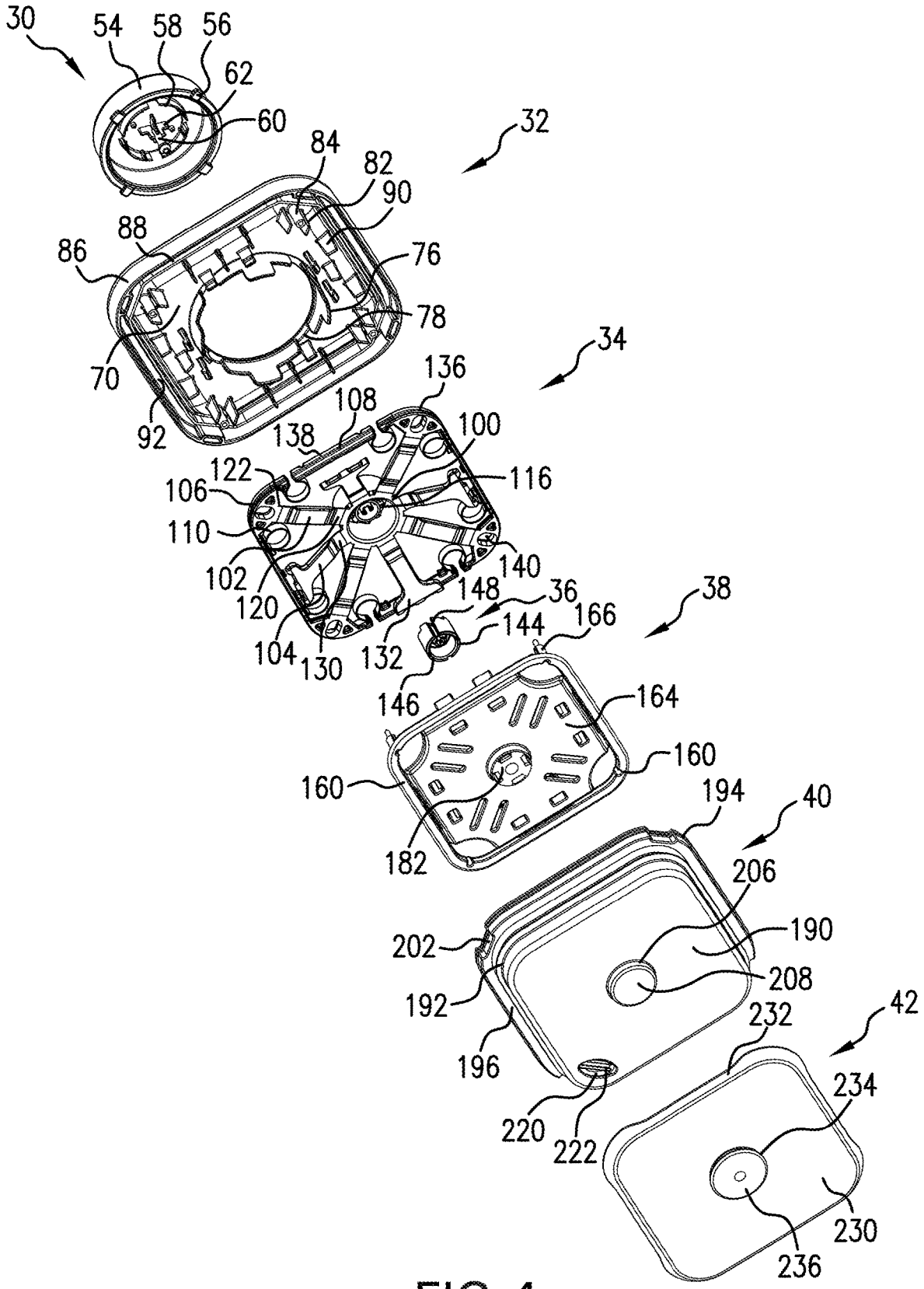
FIG. 4 is another exploded view of the lid for the container assembly depicted in FIGS. 1 and 2.

The button 30 is shown as generally circular in configuration, but the button could take other configurations such as square, rectangular, or other polygonal configurations. The button 30 includes an upper section 50 defining a top surface 52, which is the surface commonly pushed by an operator to move the button 30. The top surface 52 is generally planar in the illustrated embodiment and is typically horizontally oriented when the container 12 is resting on a horizontal surface in typical use. The button 30 includes a peripheral skirt 54 that extends downwardly from a periphery of the upper section 50. The peripheral skirt 54 is generally annular, or cylindrical, in configuration and is vertical in the illustrated embodiment when the container 12 is resting on a horizontal surface in typical use. Tabs 56 (four of which are shown in the illustrated embodiment) extend radially outwardly from a lower free end of the peripheral skirt 54. The tabs 56 facilitate connecting the button 30 with the top lid 32. With reference to FIG. 4, the button 30 includes an inner annular flange 58, which can be interrupted, extending downwardly from the upper section 50 and offset radially inwardly from the peripheral skirt 54. The button 30 further includes a barb 60, which is centrally located, and extends downwardly from the upper section 50. The barb 60 includes a cross-shaped base 62 and is provided for connecting the button 30 with the cam 36.

The top lid 32 includes a generally horizontally disposed upper section 70 that defines an upper surface 72 of the lid 14. A portion of the upper surface 72 immediately surrounding a button hole 74 is generally planar in the illustrated embodiment and is typically horizontally oriented when the container 12 is resting on a horizontal support surface, e.g. a table, and the lid 14 is covering the upper opening 22 (FIG. 2) of the container 12. The button hole 74 is provided in the top lid 32 for receiving the button 30. The button hole 74 in the illustrated embodiment is circular since the button 30 is also circular; however, the button hole 74 could take other shapes especially where the button is shaped differently. Appendages 76 depend downwardly from the upper section 70 near the button hole 74. Four appendages 76 are shown in the illustrated embodiment (see FIG. 4). Each appendage 76 is spaced from an adjacent appendage to define respective gaps 78 for receiving a respective tab 56 on the button 30. The tabs 56 move within the gaps 78 when the button 30 is depressed and released. The tabs 56 riding in the gaps 78 prevent rotational movement of the button 30 with respect to the top lid 32. The top lid 32 also includes fastener openings 82 provided in standoffs 84 (FIG. 4) to facilitate attachment of the top lid 32 with the base 38.

The top lid 32 also includes a vertically oriented peripheral skirt 86 that depends downwardly from a periphery of the upper section 70. The peripheral skirt 86 generally matches the configuration of the side wall 16 of the container 12. An internal vertical wall 88 depends downwardly from the upper section 70 and is offset inwardly from the peripheral skirt 86. The internal vertical wall 88 is the same shape as the peripheral skirt 86, but is smaller. Ribs 90, which cooperate with the web 34, extend downwardly from the upper section 70. A channel 92 is formed between the peripheral skirt 86 and the internal vertical wall 88. At least a portion of the gasket 40 is received in this channel 92.

With reference to FIG. 3, the web 34 is an integrally formed piece of plastic material including a hub 100, arms (which include longer arms 102 and shorter arms 104), gasket pushers (which include corner gasket pushers 106 and central gasket pushers 108), and tensile connector elements 110. Each arm 102, 104 connects with the hub 100 and is associated with a respective gasket pusher 106, 108. Each tensile connector element 110 connects a respective gasket pusher 106, 108 with an adjacent gasket pusher. Movement of the button 30 results in movement of the hub 100, which results in movement of the arms 102, 104 which results in movement of the gasket pushers 106, 108, which results in movement of the gasket 40.

The hub 100 includes a central opening 114 that can receive the barb 60 on the button 30. The hub 100 includes ratchet teeth 116 (FIG. 4) that cooperate with the cam 36.

The longer arms 102 extend outwardly from a lower end of the hub 100 and connect the hub 100 with the respective corner gasket pushers 106 located in the corners of the web 34. Each longer arm 102 includes a first (proximal) hinge section 120 connecting the longer arm 102 with the hub 100 and second (distal) hinge section 122 connecting a respective corner gasket pusher 106 with the longer arm 102. Each hinge section 120 and 122 operates as a flexure. Each hinge section 120 and 122 has a thickness that is smaller as compared to the section of each longer arm 102 between the hinge sections.

The shorter arms 104 also extend outwardly from a lower end of the hub 100. Each shorter arm 104 is associated with a respective central gasket pusher 108 located between respective corner gasket pushers 106 of the web 34. Each shorter arm 104 includes a proximal hinge section 130 connecting the shorter arm 104 with the hub 100 and a distal section 132 that is associated with and selectively contacts a respective central gasket pusher 108. The proximal hinge section 130 operates as a flexure. As the hub 100 is moved downward in the direction of arrow 44 (FIG. 2) per the orientation shown in FIG. 3, the distal section 132, which is wider than the remainder of the shorter arm 104, moves along the base 38 in a direction transverse (perpendicular in the illustrated embodiment) to the arrow 44 toward the respective central gasket pusher 108. As the hub 100 continues to move downward after the distal section 132 contacts the respective central gasket pusher 108, the distal section 132 pushes the respective central gasket pusher 108 in the transverse direction outwardly away from the hub 100.

Each gasket pusher 106, 108 includes a respective gasket contact surface 136, 138 that contacts the gasket 40. Each gasket contact surface 136 on the corner gasket pushers 106 is generally L-shaped and each gasket contact surface 138 on the central gasket pushers 108 is linear in plan view. Each corner gasket pusher 106 can include an opening 140 to provide a locating feature for the corner gasket pusher 106 and the web 34, and also to limit movement of the corner gasket pusher 106 (see also FIG. 5). Each central gasket pusher 108 can include notches 142 that receive the ribs 90 that extend downwardly from the upper section 70 of the top lid 32, which inhibits movement the central gasket pusher 108 in directions other than along the transverse direction mentioned above.

The tensile connector elements 110 interconnect adjacent gasket pushers 106, 108. In the illustrated embodiment, eight gasket pushers 106, 108 are provided and interconnected by eight tensile connector elements 110, and the tensile connector elements 110 are each ring-shaped. When the gasket pushers 106, 108 are in the extended position, the tensile connector elements 110 are tension urging the gasket pushers 106, 108 back toward the retracted position. The cam 36, however, maintains the gasket pushers 106, 108 in the extended position until the button 30 is pushed again after the button 30 is in the depressed position.

The cam 36 includes a cylindrical body 144 having vertical channels 146 and ratchet teeth 148. The cam 36 connects with the button 30 through the barb 60 by being inserted through the central opening 114 in the hub 100 and through an opening 152 in the cam 36. The cam 36 rotates with respect to the button 30 on the barb 60. The gasket 40 acts against the web 34 to bias the button 30 toward the projected position (FIG. 1).

Figure 5:
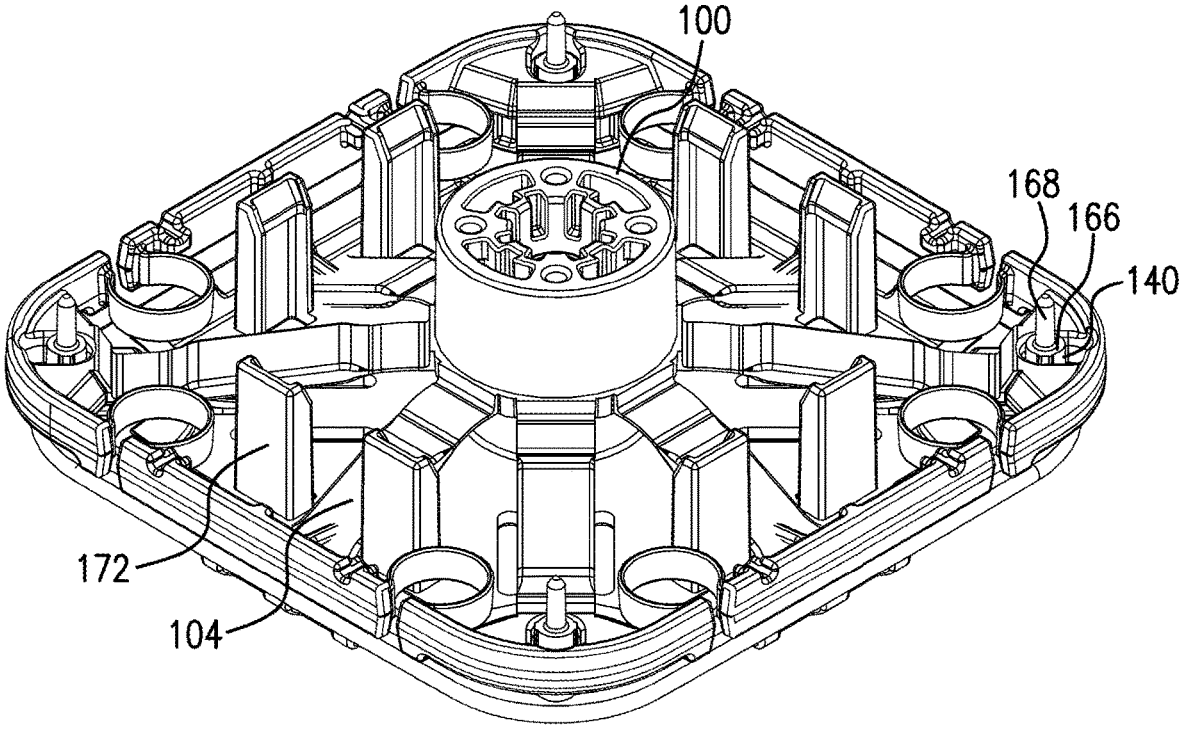
FIG. 5 is perspective view of a web on a base of the lid of the container assembly depicted in FIGS. 1 and 2.

The base 38 is formed of a plate 160 having an upper surface 162 facing toward the top lid 32 and a lower surface 164 (FIG. 4) that faces toward the inner volume 20 of the container 12 when the lid 14 is on the container. As seen in FIG. 5, corner gasket pusher standoffs 166 are received in the openings 140 provided in each corner gasket pusher 106. Fasteners 168 extend upwardly from the corner gasket pusher standoffs 166 and are received in the fastener openings 82 provided in standoffs 84 (FIG. 4) to attach the top lid 32 with the base 38. Arm standoffs 172 extend upwardly from the upper surface 162 and are appropriately spaced in pairs so that each pair receives a respective shorter arm 104. The standoffs 166 and 172 aid in locating the web 34 on the base 38. The standoffs 166 and 172 are shown as extending upwardly from the base 38; however, if desired, the standoffs could extend downwardly from the upper section 70 of the top lid 32. The base 38 connects with the top lid 32 in a manner such that the base 38 does not move with respect to the top lid 32 when the button 30 is pressed or moved with respect to the top lid 32. Instead, only the gasket 40 moves outwardly with respect to the top lid 32 and the lower plate 42.

The base 38 further includes a central annular boss 174 having inwardly extending upper projections 176 that do not extend vertically all the way to the upper surface 162. The cam 36 is received in the central annular boss 174 and the vertical channels 146 cooperate with the projections 176 so that the button 30 is stable in an projected position in which the top surface 52 of the button is offset from the upper surface 72 of the lid 14 (shown in FIG. 1) and in a depressed position in which the top surface 52 of the button 30 is nearer to the upper surface 72 of the lid 14 as compared to the projected position. The ratchet teeth 116 (FIG. 4) on the hub 100 cooperate with the ratchet teeth 148 on the cam 36 in a manner similar to a known ballpoint pen mechanism, which allows the button to maintain one of the projected position and the depressed position. When the button 30 is pushed, the button 30 pushes down on the hub 100. The inner annular flange 58, which is interrupted in the illustrated embodiment, and the cross-shaped base 62 engage the hub 100 to preclude rotation of the button 30 with respect to the hub 100. The ratchet teeth 116 on the hub 100 engage the ratchet teeth 148 on the cam 36 which pushes the cam 36 down and rotates the cam 36 when the projections 176 on the central annular boss 174 no longer engage with the vertical channels 146. Depending on the rotational orientation of the cam 36 with respect to the central annular boss 174, the button 30 is either in the projected position or the depressed position. The cam 36 is only one type of cam mechanism that is capable of maintaining the button 30 in the depressed position until pressed again while in the depressed position. Other known types of cam mechanisms could be employed.

With reference to FIG. 4, a circular boss 182 is provided on the base 38 extending downwardly away from the lower surface 164 of the plate 160. The circular boss 182 extends downwardly from the lower surface 164 to facilitate attachment of the gasket 40 and the lower plate 42.

The gasket 40 includes a gasket base 190, which is substantially planar in the illustrated embodiment. A lower side wall 192 extends upwardly from a periphery of the gasket base 190. The lower side wall 192 transitions into an upper side wall 194 through a shoulder 196; the upper side wall 194 being a larger rectangle than the lower side wall 192. The upper side wall 194 terminates at an upper free edge 198, which is received in the channel 92 formed between the peripheral skirt 86 and the internal vertical wall 88 on the top lid 32 when the lid 14 is finally assembled. Indentations 202 are provided at the corners of the upper free edge 198 to facilitate removal of the gasket 40 from the top lid 32. The gasket 40 also includes a sealing lip 204 that extends outwardly from the lower side wall 192 and towards the upper side wall 194. The sealing lip 204 is pressed against the inner surface 24 of the container 12 when the gasket 40 is in the expanded state.

The gasket 40 also includes a cylindrical wall 206 that depends downwardly from the gasket base 190. A lower circular wall 208 extends from a lower end of the cylindrical wall 206 to define a boss recess 212 that receives the boss 182 to attach the gasket 40 with the base 38. The gasket 40 covers an entirety of the lower surface 164 of the base 38 in the illustrated embodiment. The gasket 40 also includes an internal wall 216 that extends upwardly from the gasket base 190. A top wall 218 extends from an upper end of the internal wall 216 to define a grip recess 220 together with the internal wall 216. A gripping member 222 is positioned in the grip recess 220. A user can grip the gripping member 222 to remove the gasket 40 from the base 38 and the top lid 32.

The lower plate 42 includes a base wall 230 and a peripheral wall 232 extending upwardly from a periphery of the base wall 230. The lower plate 42 also includes a lower plate cylindrical wall 234 that depends downwardly from the base wall 230. The lower plate cylindrical wall 234 has a diameter slightly larger than a diameter of the lower circular wall 208. A lower plate circular wall 236 extends from a lower end of the lower plate cylindrical wall 234 to define a boss cavity 238 that receives the boss 182 and a portion of the gasket 40 surrounding the boss 182. The lower plate 42 can provide a cosmetic function and cover an entirety of the gasket base 190. The lower plate 42 is made from a smooth rigid plastic material and the gasket 40 is made from a resilient material such as silicone. The lower plate 42 can cover the gasket 40 to preclude items stored in the container 12 from sticking to the gasket 40. The lower plate 42 connects with the top lid 32 through the gasket 40 and the base 38 in a manner such that the lower plate 42 does not move with respect to the top lid 32 when the button 30 is pressed or moved with respect to the top lid 32. Instead, only the gasket 40 moves outwardly with respect to the top lid 32 and the lower plate 42. The lower plate cylindrical wall 234 can also be appropriately shaped to allow for the connection of utensils (e.g., spoons, scoopers) and other tools that can be stored in the container 12 along with other contents of the container 12.

The button 30 is moveable in a first axial direction (parallel with arrow 44 in FIG. 2) with respect to the top lid 32 between an projected position (shown in FIG. 2) and a depressed position where the top surface 52 of the button 30 would be flush with the upper surface 72 of the lid 14. Because of the cam 36 being similar to a known ballpoint pen mechanism and the connection between the cam 36 and the button 30, the button 30 can remain in the depressed position until pressed again, at which time the gasket 40, being made from a resilient material, would bias the button 30 from the depressed position toward the projected position. Movement of the button 30 from the projected position toward the depressed position results in pivotal movement of at least one of the arms 102, 104 (each arm in the illustrated embodiment).

The lid 14 can be assembled in an easy manner. A method for assembling the lid 14 includes placing the cam 36 on the base 38, and placing the web 34 on the base 38. The method further includes connecting the button 30 with the cam 36, placing the top lid 32 on the base 38, and connecting the base 38 with the top lid 32. The method further includes attaching the gasket 40 to the base 38 and attaching the lower plate 42 to at least one of the base 38 and the gasket 40. The boss 182 on the base 38 can be inserted into the boss cavity 238 in the lower plate 42 with the gasket 40 attached to the base 38. The boss 182 on the base 38 can be inserted into the boss recess 212 in the gasket 40 prior to inserting the boss 182 into the boss cavity 238.

The method for assembling the lid 14 can allow for the easy stacking of components on top of one another, which facilitates the assembly process. The order of the steps described above need not be performed in the exact order described.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A storage container assembly comprising:

a container having an opening;

a lid for covering the opening, the lid including a top lid defining an upper surface of the lid;

a button movable in a first axial direction with respect to the top lid between a projected position in which a top surface of the button is offset from the upper surface of the lid and a depressed position in which the top surface of the button is nearer to the upper surface of the lid as compared to the projected position;

a cam configured to cooperate with the button such that the button maintains the depressed position when moved from the projected position to the depressed position, and the button remains in the depressed position until pressed again while in the depressed position;

a base connected with the top lid, wherein the cam is positioned between the button and the base;

a lower plate connected with the top lid; and a gasket separable from the lower plate, the gasket being movable between a contracted state and an expanded state in response to alternate actuations of the button, wherein the gasket is interposed between the lower plate and the top lid.

2. The storage container assembly of claim 1, wherein the gasket covers an entirety of a lower surface of the base.

3. The storage container assembly of claim 2, wherein the base includes a boss and the gasket includes a boss recess that receives the boss.

4. The storage container assembly of claim 3, wherein the lower plate includes a boss cavity that receives the boss and a portion of the gasket surrounding the boss.

5. The storage container assembly of claim 1, wherein the gasket includes a gasket base and a side wall extending upwardly from the gasket base, wherein the lower plate covers an entirety of the gasket base.

6. The storage container assembly of claim 5, wherein the gasket includes an internal wall extending upwardly from the gasket base to define a grip recess and a gripping member positioned in the grip recess.

7. The storage container assembly of claim 1, wherein the gasket includes a side wall and sealing lip extending outwardly from the side wall.

8. The storage container assembly of claim 1, further comprising:

a gasket pusher movable in a second axial direction, which is transverse to the first axial direction, between a retracted position and an extended position, wherein the gasket pusher pushes the gasket toward the expanded state when moving from the retracted position toward the extended position; and an arm operatively connecting the button with the gasket pusher, wherein movement of the button from the projected position toward the depressed position results in pivotal movement of the arm and moves the gasket pusher in the second axial direction, which results in the gasket moving toward the expanded state.

9. The storage container assembly of claim 8, wherein the gasket pusher is one of a plurality of gasket pushers and the arm is one of a plurality of arms, wherein the lid further includes a web, which is an integrally formed piece of plastic material, including the plurality of gasket pushers and a plurality of tensile connector elements, wherein each of the tensile connector elements interconnects adjacent gasket pushers.

10. The storage container assembly of claim 9, wherein at least one arm of the plurality of arms includes a distal section that is offset from a respective gasket pusher when the button is in the projected position.

11. The storage container assembly of claim 9, wherein the web includes a hub and at least one arm of the plurality of arms includes a first hinge section connecting the respective arm with the hub.

12. The storage container assembly of claim 11, wherein at least one arm of the plurality of arms includes a second hinge section connecting a respective gasket pusher with the respective arm that includes the second hinge section.

13. The storage container assembly of claim 1, wherein the lower plate connects with the top lid in such a manner that the lower plate does not move with respect to the top lid when the button is moved with respect to the top lid.

14. The storage container assembly of claim 1, wherein the base connects with the top lid in such a manner that the base does not move with respect to the top lid when the button is moved with respect to the top lid.

15. A method for assembling a lid, the method comprising:

placing a cam on a base;

placing a web on the base, wherein the web includes a hub, a plurality of arms, a plurality of gasket pushers and a plurality of tensile connector elements, each arm is connected with the hub and associated with a respective gasket pusher, and each tensile connector element interconnects adjacent gasket pushers;

connecting a button with the cam;

placing a top lid on the base and connecting the base with the top lid, wherein the top lid includes a button hole receiving the button;

attaching a gasket to the base; and attaching a lower plate to the gasket.

16. The method of claim 15, wherein attaching the lower plate includes inserting a boss on the base into a boss cavity in the lower plate.

17. The method of claim 15, wherein attaching the gasket includes inserting a boss on the base into a boss recess in the gasket.

18. The method of claim 15, wherein attaching the gasket includes covering an entirety of a lower surface of the base with the gasket.

19. The method of claim 15, wherein attaching the lower plate includes covering an entirety of a gasket base of the gasket with the lower plate.

20. The storage container assembly of claim 1, wherein the lower plate and the gasket are made from dissimilar materials.

* * * * *